US010488152B1

(12) United States Patent
de Nijs

(10) Patent No.: US 10,488,152 B1
(45) Date of Patent: Nov. 26, 2019

(54) REPLACEABLE COVER FOR AN ACCESSORY CONTAINER

(71) Applicant: Kurt H. de Nijs, Westerville, OH (US)

(72) Inventor: Kurt H. de Nijs, Westerville, OH (US)

( * ) Notice: Subject to any disclaimer, the term of this patent is extended or adjusted under 35 U.S.C. 154(b) by 0 days.

(21) Appl. No.: 16/231,893

(22) Filed: Dec. 24, 2018

Related U.S. Application Data

(63) Continuation of application No. 15/174,711, filed on Jun. 6, 2016, now Pat. No. 10,161,714, which is a continuation-in-part of application No. 12/906,956, filed on Oct. 18, 2010, now Pat. No. 9,360,275.

(51) Int. Cl.
*F41C 33/02* (2006.01)
*F41C 33/04* (2006.01)
*A45F 5/02* (2006.01)

(52) U.S. Cl.
CPC ..... *F41C 33/0218* (2013.01); *A45F 5/021* (2013.01); *F41C 33/041* (2013.01)

(58) Field of Classification Search
CPC .. F41C 33/02; F41C 33/0209; F41C 33/0227; F41C 33/04; F41C 33/0218; A45F 2200/059; B65D 25/34; Y10S 224/911; Y10S 224/912
See application file for complete search history.

(56) References Cited

U.S. PATENT DOCUMENTS 3,645,428 A * 2/1972 Angell ..... F41C 33/0209 224/244
3,688,953 A * 9/1972 Bianchi ..... F41C 33/0218 224/192
4,277,007 A * 7/1981 Bianchi ..... F41C 33/0209 224/193
4,504,001 A * 3/1985 Nichols ..... F41C 33/045 224/198
4,694,980 A * 9/1987 Rogers ..... F41C 33/0227 224/238
4,925,075 A * 5/1990 Rogers ..... F41C 33/0245 224/192
5,318,821 A * 6/1994 Bradley, Jr. ..... B65D 25/34 150/154
5,931,358 A * 8/1999 Rogers ..... F41C 33/02 224/243
2005/0184115 A1* 8/2005 Wells ..... A45F 5/02 224/193

(Continued)

*Primary Examiner* — Brian D Nash

(74) *Attorney, Agent, or Firm* — Shaddock Law Group, PC

(57) ABSTRACT

An accessory container and replaceable cover system having a container comprising an inside surface and an outside surface, wherein the inside surface defines a cavity configured to retain at least a portion of an accessory; a cover adapted to be selectively attached to and fit about at least a portion of the outside surface of the container, and one or more apertures formed in the cover so as to provide at least one aligned, overlapping aperture when the cover is positioned about the container; an attachment element adapted to be selectively connected to the container; and a fastener, wherein the fastener passes through the at least one aligned, overlapping aperture in the cover and at least one aligned aperture in the attachment element, and wherein the fastener releasably holds the cover on the container and releasably holds the attachment element on the container.

20 Claims, 21 Drawing Sheets

(56) References Cited

U.S. PATENT DOCUMENTS

| | | | | |
|---|---|---|---|---|
| 2006/0144882 | A1* | 7/2006 | Clifton, Jr. | A45F 5/00 224/222 |
| 2007/0045364 | A1* | 3/2007 | Grundy | A45F 5/02 224/197 |
| 2007/0068982 | A1* | 3/2007 | Grundy | A45F 5/02 224/236 |
| 2007/0181619 | A1* | 8/2007 | Seyfert | F41C 33/0227 224/196 |
| 2012/0091175 | A1* | 4/2012 | De Nijs | F41C 33/0209 224/238 |
| 2017/0016696 | A1* | 1/2017 | Koskan | F41C 33/0209 |

* cited by examiner

FIG. 7
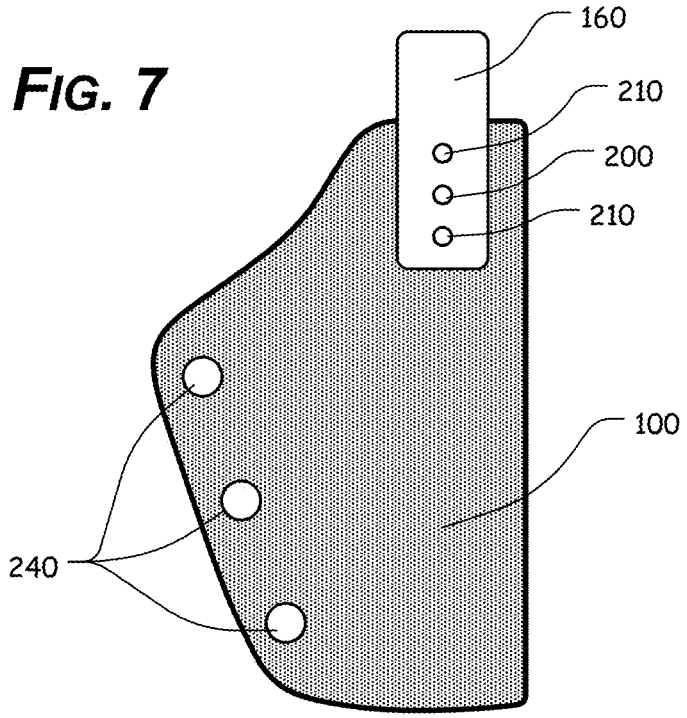
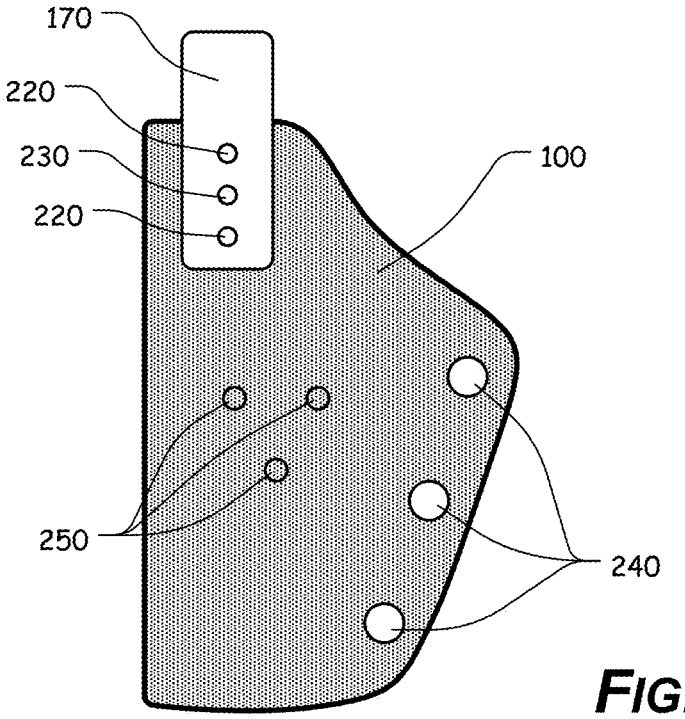
FIG. 8

REPLACEABLE COVER FOR AN ACCESSORY CONTAINER

CROSS-REFERENCE TO RELATED APPLICATIONS

This is a Continuation of co-pending U.S. patent application Ser. No. 15/174,711, filed Jun. 6, 2016, now U.S. Pat. No. 10,161,714, issued Dec. 25, 2018, which is a Continuation-In-Part of co-pending U.S. patent application Ser. No. 12/906,956, filed Oct. 18, 2010, now U.S. Pat. No. 9,360,275, issued Jun. 7, 2016, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to holsters. In particular, exemplary embodiments of the disclosure relate to a holster for containing and/or protecting accessories such as but not limited to a gun, chemical agent, weapon, electrical discharge "stunning" device, power tool, knife, pager, radio, pda, telephone, and other similar communication and computing device, etc., where the holster comprises a container, a cover adapted to fit about the container, and a securing means that selectively holds the cover in a desired position about the container.

2. Description of Related Art

A holster is a device used to contain or restrict the undesired movement of an accessory, such as a handgun, most commonly in a location where it can be easily withdrawn for immediate use. Holsters can also be utilized to contain accessories such as knives, chemical agents, batons and other impact weapons, power tools, etc. Because the accessory being contained by the holster is often times repeatedly inserted and subsequently removed from the holster—often at a quick rate—a holster is subjected to many different elements and can be worn down. Moisture can do damage internally as well. Moisture, abrasion caused by many sources, temperature extremes, and even sunlight are but a few examples of the conditions and elements that can cause wear and damage to a holster's exterior. In many professions such as those of law enforcement and the military, maintaining a certain level of appearance is desired or required. Thus, when the holster begins to look worn, or in the case of leather contaminated or stained by substances such as water, chemicals of all sorts, and various bodily fluids, the entire holster needs to be replaced. This is done regardless of whether the rest of the holster is in working condition. There might also be a need to change out the covering, though there is no wear at all. A law enforcement agency might want to change from high-gloss to basketweave. A military unit might want to change from one camouflage style to another.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE DISCLOSURE

However, the typical holster arrangement has various disadvantages and shortcomings. Thus, there is a need for a holster comprising multiple units such that a portion of the holster may be discarded without having to replace the entire holster.

In various exemplary, non-limiting embodiments, the holster of the present disclosure comprises a container, a cover adapted to fit about the container, and a securing means that selectively holds the cover in a desired position about the container. In certain exemplary embodiments, the container may be three-dimensional and define a cavity (e.g., a pocket) for containing an accessory. For example, the container may be a compartment substantially open on at least one side where the compartment is shaped to contain a specific accessory including but not limited to a gun, a magazine, a knife, a baton or impact weapon, chemical agent, ammunition for gun, a flashlight, handcuffs, protective gloves, an electrical discharge stunning device, a recorder, pager, radio, pda, telephone, and other similar communication and computing devices and batteries for them. The cover may have a shape that corresponds to the three-dimensional shape of the container. In certain exemplary embodiments, the securing means holds the cover about the outer portion of the container until it is desired that the cover be removed. The securing means may comprise a screw, snap, hook & loop with removable adhesive, clamp, etc. In an exemplary embodiment, a replacement cover may be applied to the container and selectively held in place by the securing means. For example, the replacement cover may be substantially the same as the preceding cover. However, in alternative embodiments, the replacement cover may be different than the preceding cover such as in size, shape, color, or other material characteristics.

In various exemplary, nonlimiting embodiments, each of the components of the accessory container and replaceable cover system, i.e., the cover, the attachment element, the container, and/or the flat is each individually replaceable.

Accordingly, the present disclosure separately provides an improved holster or container.

The present disclosure separately provides an improved holster or container that allows for replacement of a holster or container cover.

The present disclosure separately provides an improved holster or container that allows for replacement of a holster or container cover without replacement of the entire holster or container.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following figures, wherein like reference numerals refer to like parts throughout the several views, and wherein:

FIG. 7 illustrates a front perspective view of an exemplary container comprising a retention strap shown selectively connected to the container cover, according to the present disclosure;

FIG. 8 illustrates a back perspective view of the exemplary holster of FIG. 7 comprising a thumb break strap connected to the exemplary container, according to the present disclosure;

DETAILED DESCRIPTION OF THE DISCLOSURE

Figure 1:
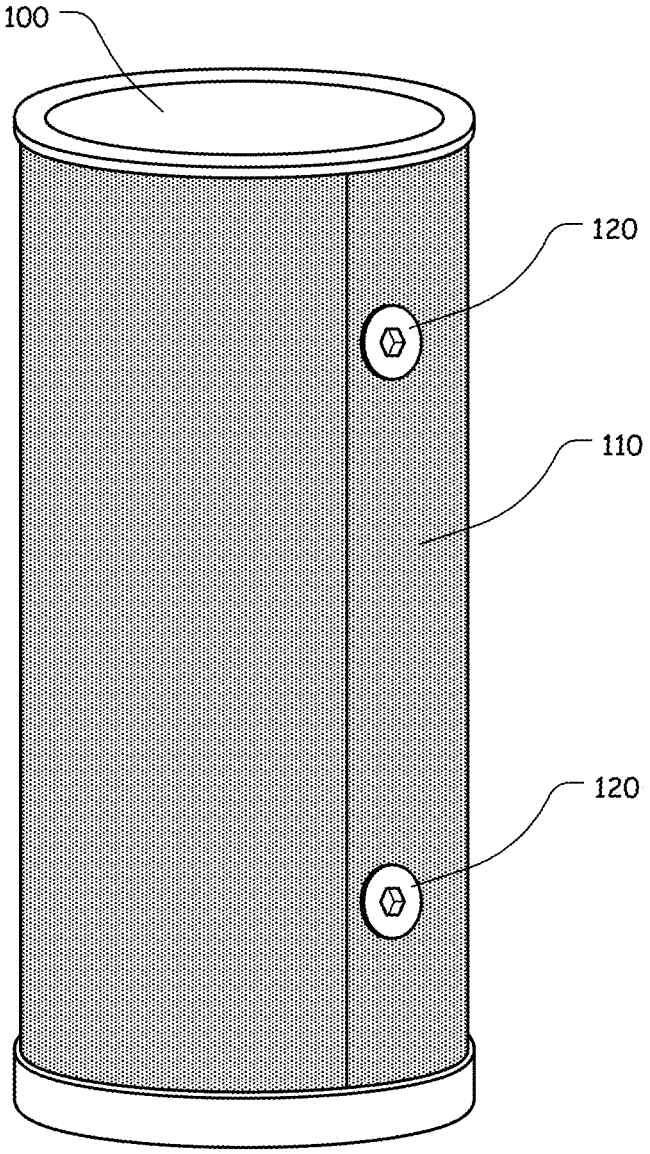
FIG. 1 illustrates a back perspective view of an exemplary embodiment of a holster, according to the present disclosure.

For simplicity and clarification, the design factors and operating principles of the accessory container and replaceable cover system according to the present disclosure are explained with reference to various exemplary embodiments of an accessory container and replaceable cover system according to the present disclosure. The basic explanation of the design factors and operating principles of the accessory container and replaceable cover system is applicable for the understanding, design, and operation of the accessory container and replaceable cover system of this disclosure. It should be appreciated that the accessory container and replaceable cover system can be adapted to many applications where an accessory container and replaceable cover system or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "accessory container", "accessory", and "cover" are used for basic explanation and understanding of the operation of the systems, methods, and apparatuses of this disclosure. Therefore, the terms "accessory container", "accessory", and "cover" are not to be construed as limiting the systems, methods, and apparatuses of this disclosure.

For simplicity and clarification, the accessory container and replaceable cover system of this disclosure will be described as being used in conjunction with certain specific accessories. However, it should be appreciated that these are merely exemplary embodiments of the accessory container and replaceable cover system and are not to be construed as limiting this disclosure. Thus, the accessory container and replaceable cover system of this disclosure may be utilized in conjunction with any firearm, accessory, object, or device.

Turning now to the drawing Figs., FIGS. 1-16 illustrate certain elements and/or aspects of an accessory container and replaceable cover system, according to the present disclosure. In illustrative, non-limiting embodiment(s) of this disclosure, as illustrated in FIG. 1, an exemplary embodiment of a holster comprises a container 100, a cover 110 adapted to fit about the container, and a securing means 120 that selectively holds the cover 110 in a desired position about the container 100. In certain exemplary embodiments, the container 100 is three-dimensional and defines a cavity for containing an accessory. In one exemplary embodiment, the container 100 may be a case or a pouch for containing multiple accessories rather than a holster for containing a single accessory. The container 100 may be a compartment substantially open on at least one side, where the compartment is shaped to contain a specific accessory such as a gun, knife, baton, magazine, chemical agent, power tool, toy gun, etc. The cover 110 may have a shape that substantially corresponds to the three-dimensional shape of the container 100. In some exemplary embodiments, the container has an inside surface and an outside surface where the inside surface defines a cavity for containing an accessory or accessories, and the cover substantially covers the outside of the container when the cover has been selectively positioned about the container. In another exemplary embodiment where the container has an inside surface and outside surface, the cover may be adapted to fit about a portion of the outside surface. When the holster is adapted to be worn by a user, the cover may be adapted to fit about the portion of the container' outside surface that faces away from the body of the user when worn. In certain exemplary embodiments, the securing means 120 holds the cover 110 about the outer portion of the container 100 until it is desired that the cover 110 be removed. In some exemplary embodiments, the securing means 120 may comprise a screw, snap, hook & loop, clamp, adhesive, or other suitable fastening means.

Figure 2:
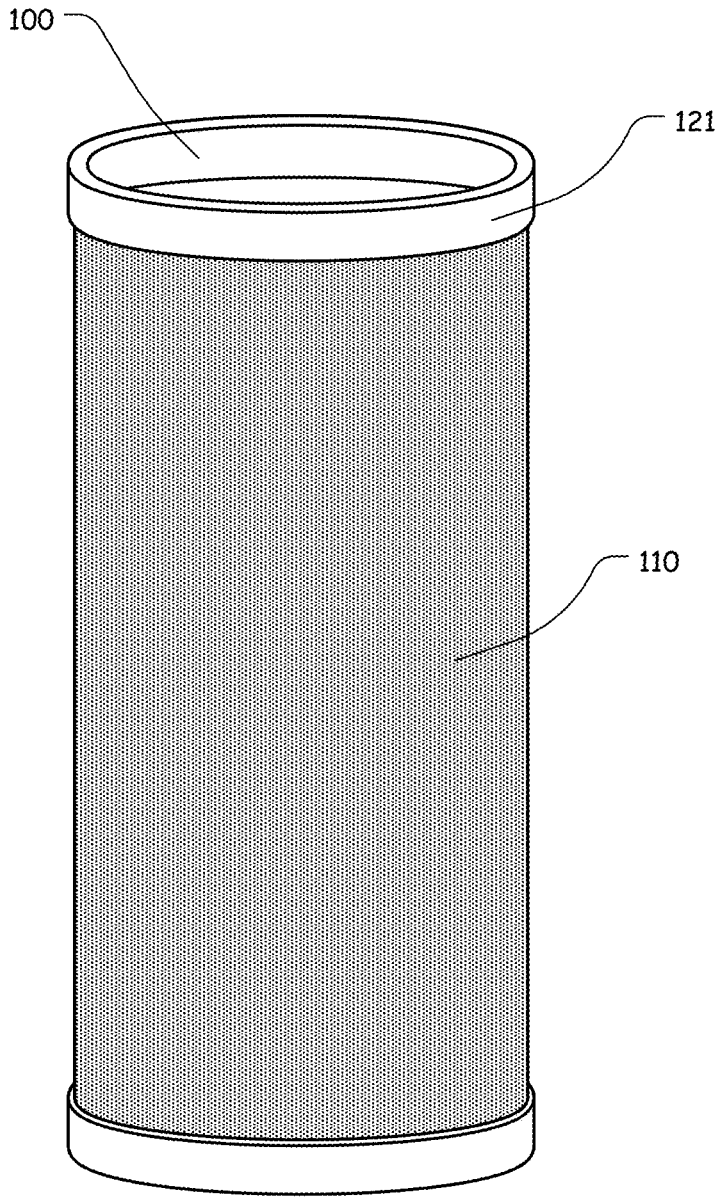
FIG. 2 illustrates a front perspective view of an exemplary embodiment where the securing means comprises an exemplary clamp, according to the present disclosure.

In a certain exemplary embodiments, as shown in FIG. 2, a securing means 120 may comprise a clamp 121. The clamp 121 may be such that it fits about an entire edge of the container. In such an exemplary embodiment, the clamp 121 may form an edge for both the container and the cover when the securing means is selectively holding the cover in a desired position about the container.

Figure 3:
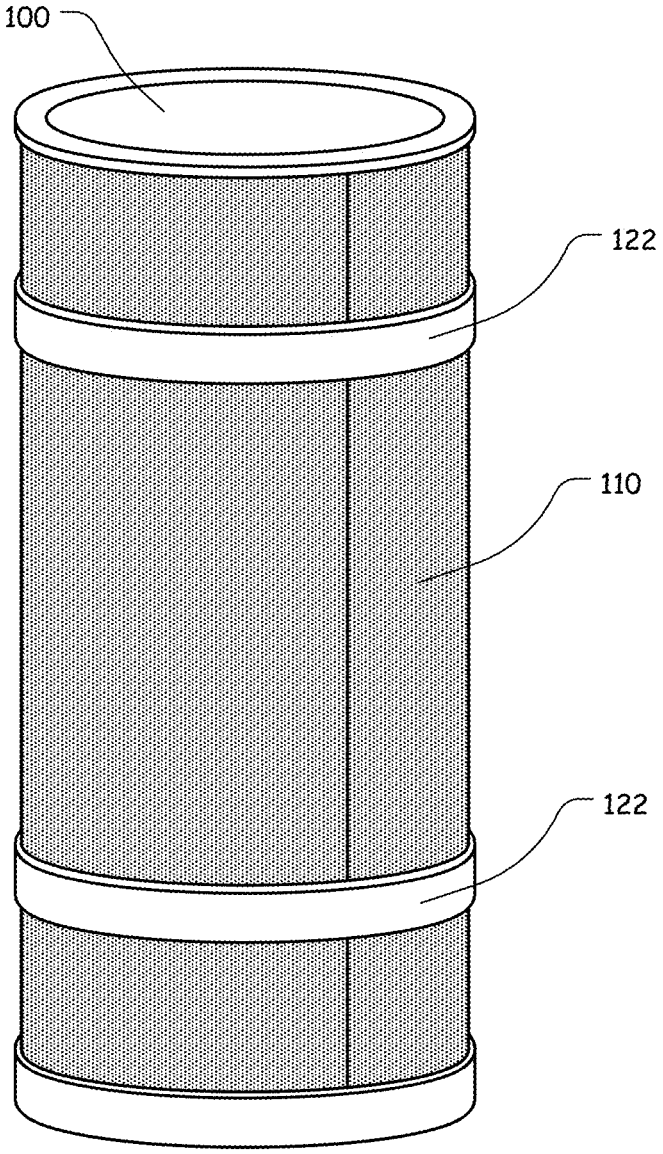
FIG. 3 illustrates a back perspective view of an exemplary embodiment where the securing means comprises an exemplary band, according to the present disclosure.

In another exemplary embodiment, as shown in FIG. 3, a securing means may hold a cover in a desired place about a container without physically coming into contact with the container. For example, a securing means may be a band 122 that is placed about the cover, applying a force to the cover and holding the cover in a desired position. In yet another exemplary embodiment, the cover comprises a first edge and a second edge, and the securing means comprises a latch that is connected to the first edge of the cover and that can be selectively connected to the second edge of the cover when it is desired that the cover be held in place about the container.

Figure 4A:
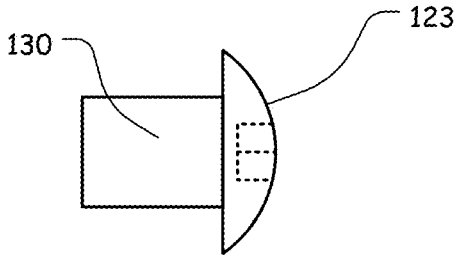
FIG. 4A illustrates an exemplary embodiment of a screw that may be utilized as a securing means for an exemplary screw post that may be utilized in certain exemplary embodiments, according to the present disclosure.
Figure 4B:
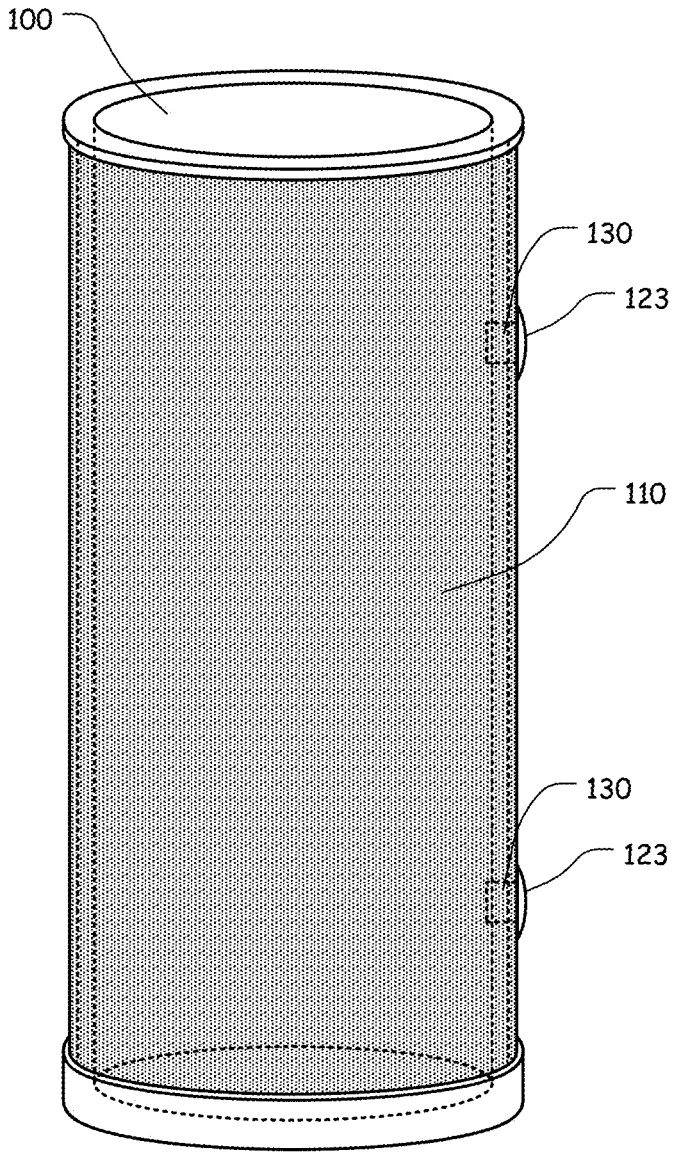
FIG. 4B illustrates an exemplary embodiment of a holster where the securing means comprises a screw being received by an exemplary screw post, according to the present disclosure.

In certain exemplary embodiments, the securing means comprises a screw 123. In exemplary embodiments comprising a screw 123, the container and the cover may each define an opening adapted to receive the screw 123 such that when the screw 123 has been received by the holes of the container and the cover, the cover is held in a desired location about the container. In exemplary embodiments where the securing means comprises a screw 123, the container may comprise a screw post 130 where the screw post 130 prevents the end of the screw 123 from coming into contact with the contents of the holster. This may prevent a screw 123 from scratching a gun, knife, power tool, etc. that is being contained by the holster. The screw post 130 may, for example, comprise a polymeric material that cushions the screw 123 as well as the contents of the holster. In another exemplary embodiment, the screw post 130 may be made out of the same material as the container. FIGS. 4A and 4B show an exemplary embodiment of a screw post 130. In another exemplary embodiment where the securing means comprises a screw 123, the screw 123 may be such that it does not fully penetrate the container. In other words, the screw 123 may go completely through a cover and be received by an opening in a first side of the container where the opening does not fully extend between the first side of the container and a second side of the container. Such a configuration may prevent contents of the container from being scratched by the securing means.

In one exemplary embodiment, a container may be utilized with more than one cover. Various covers may comprise different images based on different applications of the holster. For example a first holster may be all black for use in the nighttime, while a second holster may be camouflage, and a third holster may comprise a reflective finish. In one exemplary embodiment comprising more than one cover, a first cover must be selectively removed from the container before a second cover can be selectively attached thereto.

In one exemplary embodiment, a holster further comprises an attachment element. The attachment element may permit an individual using the holster to wear it on his or her body. The attachment element may comprise a belt loop for duty use, belt loop for plain clothes, swivel belt loop attachment, shoulder harness, paddle attachment, clip, clamp, MOLLE-type or MOLLE-compatible device, tactical platform, straps and loops. In an exemplary embodiment, the attachment element is connected to the container such that the cover can be selectively attached and detached from the container without having to disconnect the attachment element from the container. In another exemplary embodiment, an attachment element may be removed in order to selectively remove the cover from the container, and the attachment element may be re-secured to the container after or as a new cover is put in place on the container.

Figure 5:
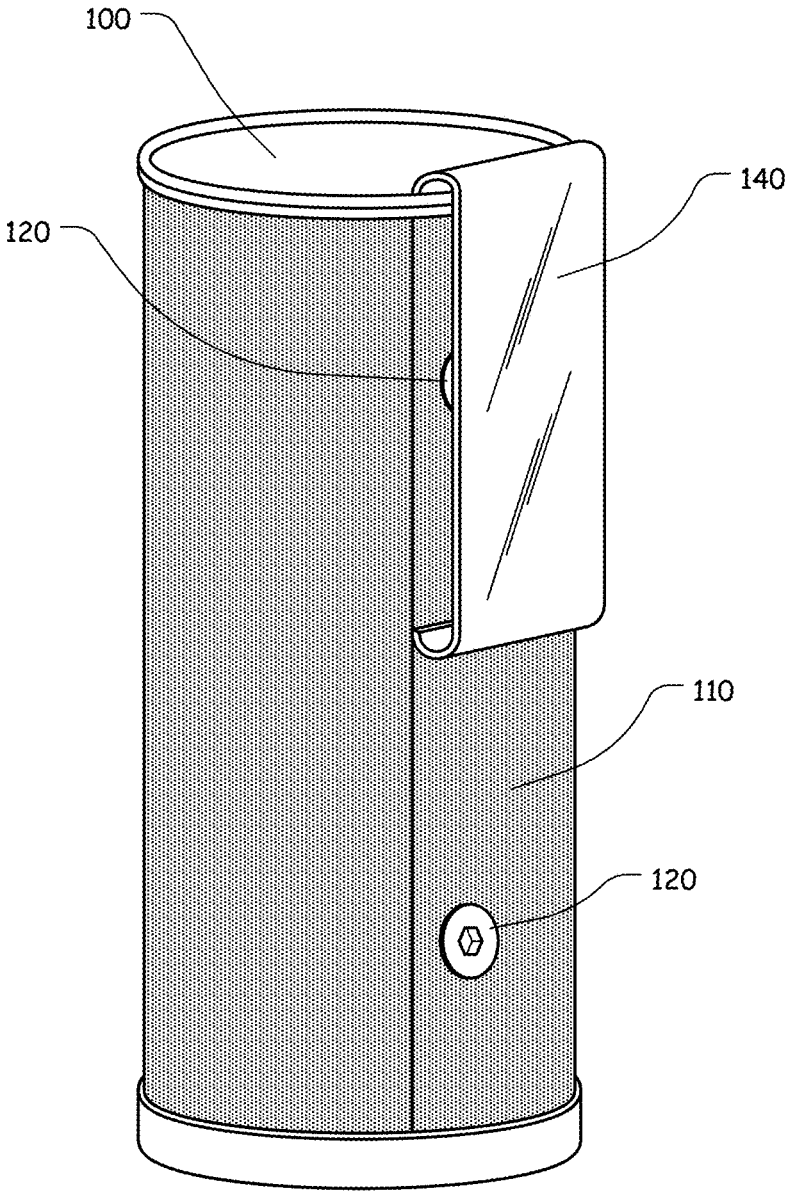
FIG. 5 illustrates a rear perspective view of an exemplary embodiment of a holster comprising an exemplary attachment element, according to the present disclosure.

In one exemplary embodiment, a securing means 120 selectively secures a cover 110 about a container 100 as well as selectively connects an attachment element to the cover and/or container. The attachment element 140 may be a belt loop attachment as shown in FIG. 5. When an attachment element may be selectively connected to a cover and/or container by a securing means, the attachment element may be replaced for a different attachment element when desired or needed. This may enable a holster to be utilized with a variety of types of attachment element. A variety of types of attachment element may be utilized with exemplary embodiments of the present disclosure. For example, belt loops for law enforcement use while on duty, belt loops for plain clothes concealment or sport use, swivel belt loops, shoulder harnesses, tactical vests, straps or loops for weaving the harness on a vest, belt, or tactical platform, belt and thigh attachments, etc. may all be utilized as attachment element. In another exemplary embodiment, an attachment element may be selectively or permanently secured to the container such that a cover may be removed and/or replaced without removing the attachment element.

Some exemplary embodiments comprise a container, a cover adapted to fit about the container, a first securing means for securing the cover to the container, and a second securing means for selectively attaching the cover to a holster accessory. A holster accessory may comprise an attachment element in some embodiments. In other exemplary embodiments, a holster accessory may be a hood, flap, thumb break, retention strap, etc. A tactical platform is typically woven with straps onto a vest, belt, thigh rig, etc. Thus, when a tactical platform is an accessory selectively attached to the cover, a user may be able to wear the holster on his or her body in a variety of ways. A hood is a retention device that helps retain a holstered firearm and is typically deactivated by a user with his or her thumb. In some exemplary embodiments, the second securing means may be utilized to selectively attach different types of accessories to the cover. Some exemplary embodiments comprise a container, a holster accessory connected to the container, a cover adapted to fit about the container, and a securing means for securing the cover to the container. In some embodiments, the container defines an inside surface, and the holster accessory is connected to the inside surface of the container. In other exemplary embodiments, the holster accessory is connected to the outside surface of the container. In exemplary embodiments where the holster accessory is connected to the outside surface of the container, the cover may define an opening that accommodates the holster accessory when the cover has been selectively attached to the container. In some exemplary embodiments, a holster attachment may be permanently attached to a container via sewing, adhesive, rivets, etc. In other exemplary embodiments, a holster accessory is selectively connected to a container via a securing means.

Figure 6:
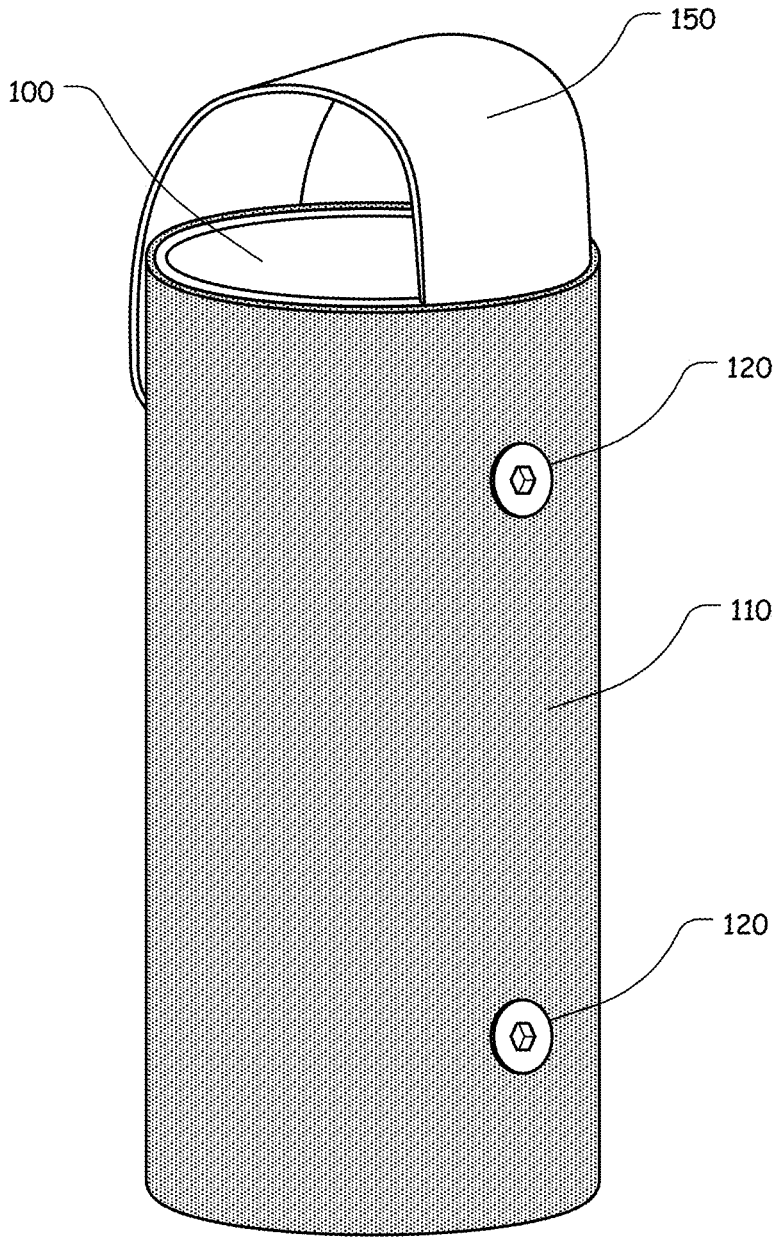
FIG. 6 illustrates a rear perspective view of an exemplary holster comprising an exemplary flap that may be selectively detached from the container, according to the present disclosure.

Such as shown in FIG. 6, one exemplary embodiment comprises a container 100 with an inner and outer surface, a cover 110 adapted to fit about the outer surface of the container, a flap 150 adapted to connect to the inner or outer surface of the container such that when connected a portion of the flap can be used to cover the contents of the container, and a securing means 120 that selectively holds the cover in a desired place about the container as well as selectively holds the flap in a desired position on the inner or outer surface of the container. Another exemplary embodiment comprises a container with an inner and outer surface, a cover adapted to fit about the outer surface of the container, a flap adapted to connect to the inner or outer surface of the container, a first securing means for selectively holding the cover in a desired location about the container, and a second securing means for holding the flap in a desired position on the inner or outer surface of the container. The first securing means and the second securing means do not necessarily have to be of the same type. For example, the first securing means may be a screw 123 that runs between the cover and the container when the cover is selectively attached to the container, while the second securing means may be a snap comprising a snapping member attached to the flap and a snapping member receiver attached to the inner or outer portion of the container. The second securing means may comprise hook & loop in some embodiments. In one exemplary embodiment where the second securing means comprises hook & loop, a flap may be selectively connected to the inside or outside of the container by the hook & loop.

Some exemplary embodiments comprising a flap may further comprise a flap closing means. The flap closing means may connect part of the flap to a desired location on the container so that the flap may be utilized to cover the contents of the container when the flap has been selectively attached to the container. A flap closing means may be a snap, hook & loop, tie, clamp, magnet, etc. that runs between the flap and the container when it is desired that at least part of the flap be held in a position on the container. It may be necessary to configure the cover such that it defines an opening for utilizing a flap closing means. In another exemplary embodiment, the flap closing means may connect part of the flap to a desired location on the cover so that the flap may be utilized to cover the contents of the container when the flap has been selectively attached to the cover. In such embodiments, a flap closing means may be a snap, hook & loop, tie, clamp, magnet, etc. that runs between the flap and the cover when it is desired that at least part of the flap be held in a position on the cover.

Some exemplary embodiments further comprise a retention strap 160 and thumb break 170. In an exemplary embodiment as shown in FIG. 7, the retention strap 160 may be selectively attached to a container via a snap or other securing means where the securing means is received by a first opening or openings 210 defined by the retention strap. In exemplary embodiments comprising a cover, the retention strap may define a second opening or openings 220 for receiving a securing means that selectively connects the cover to the container. As shown in FIG. 8, the thumb break 170 may be selectively connected to the container on a side of the container that may be opposite the side to which the retention strap may be selectively connected. The thumb break 170 may be selectively connected to the container 100 via a second securing means that is received by a first opening or openings 220 defined by the thumb break. In exemplary embodiments comprising a cover, the thumb break may define a second opening or openings 230 for receiving a securing means that selectively connects the covering to the container. The exemplary embodiment may further comprise a cover adapted to fit about the container. The cover may fit about the retention strap and thumb break once they have been selectively connected to the container. As shown in FIGS. 7 and 8, the container may further define a first opening or openings 240 for receiving a securing means that secures the cover to the container and a second opening or openings 250 for receiving a securing means that selectively secures an accessory to the cover or container.

One exemplary embodiment may comprise a container, a cover comprising a first layer and a second layer where the cover is adapted to fit about the container, a thumb break, and a retention strap, where the thumb break and retention strap are selectively positioned between the first layer and second layer of the cover when the cover is selectively connected to the container via a securing means. In one exemplary embodiment, a securing means may be utilized to selectively hold each of the thumb break and the retention strap to the first layer of the cover. In further exemplary embodiments, a thumb break and retention strap may instead be positioned directly against the container or on the outside of the cover.

Another exemplary embodiment comprises a container with an inner and outer surface, a cover adapted to fit about the outer surface of the container, a securing means for selectively holding the cover in a desired position about the container, and a retention strap and thumb break connected to the container. In an exemplary embodiment, the retention strap and thumb break are selectively connected to the cover or the container by a snap, tie, clamp, button, etc. In another exemplary embodiment, the retention strap and thumb break may be part of the container.

Figure 9A:
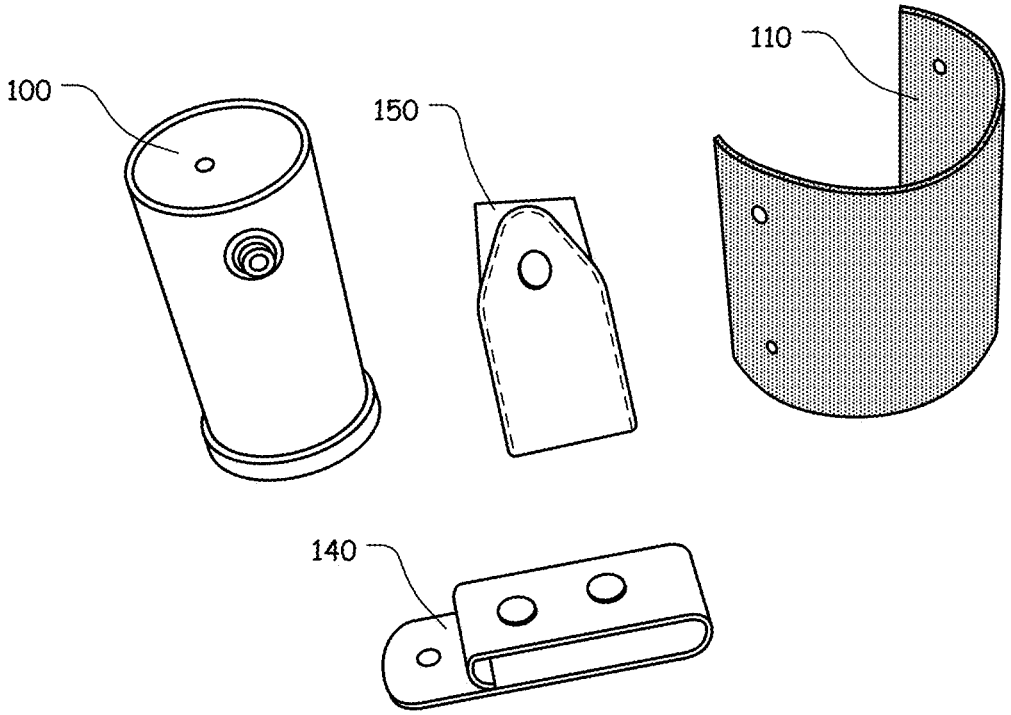
FIG. 9A illustrates a top perspective view of exemplary components of a holster, according to the present disclosure.
Figure 9B:
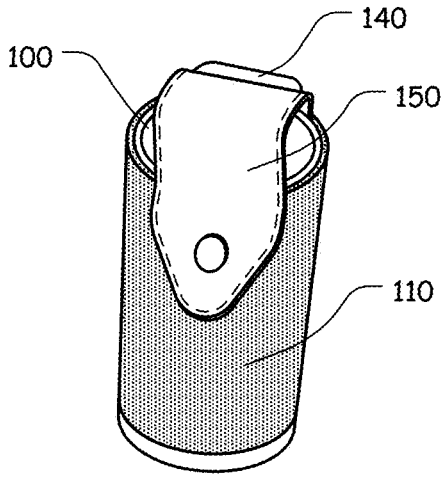
FIG. 9B illustrates an exemplary embodiment of how the exemplary components may be assembled into a holster, according to the present disclosure.
Figure 10A:
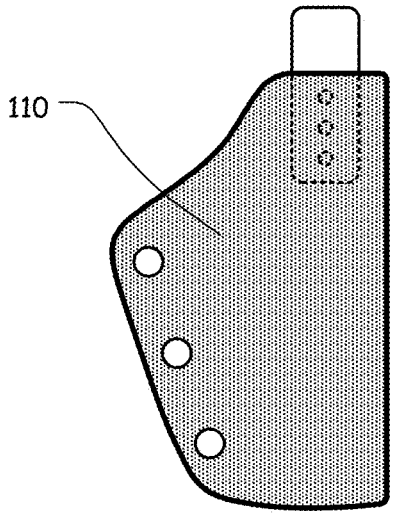
FIG. 10A illustrates an exemplary embodiment having a container adapted to contain a gun, according to the present disclosure.
Figure 10B:
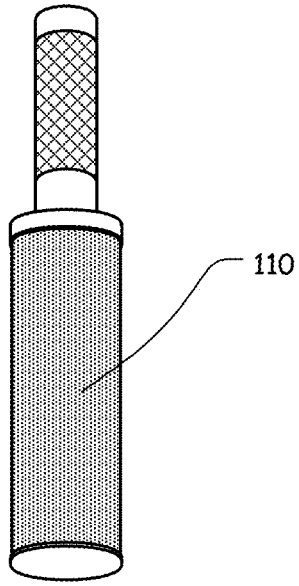
FIG. 10B illustrates an exemplary embodiment having a container adapted to contain expandable batons, according to the present disclosure.
Figure 10C:
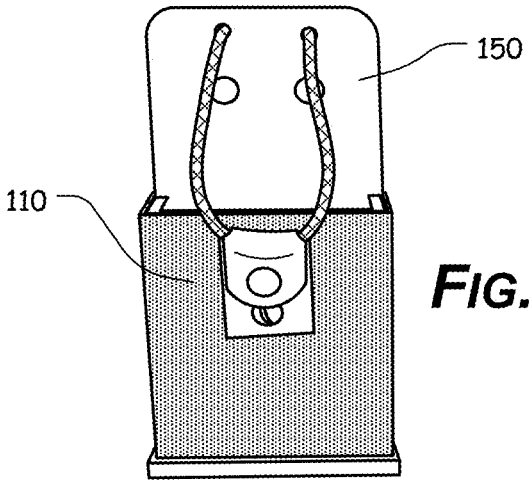
FIG. 10C illustrates an exemplary embodiment having a container adapted to contain a radio, according to the present disclosure.
Figure 10D:
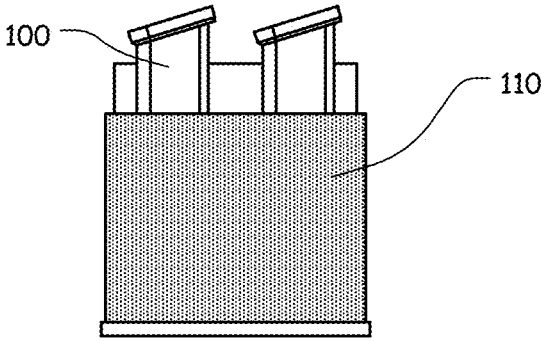
FIG. 10D illustrates an exemplary embodiment having a container adapted to contain a magazine, according to the present disclosure.
Figure 10E:
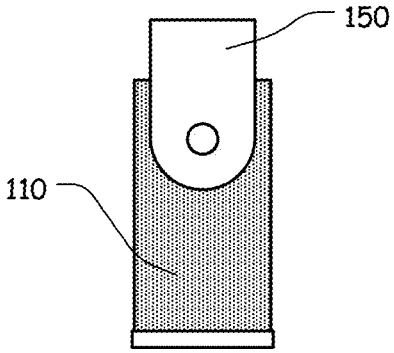
FIG. 10E illustrates an exemplary embodiment having a container adapted to contain a chemical agent, according to the present disclosure.
Figure 11:
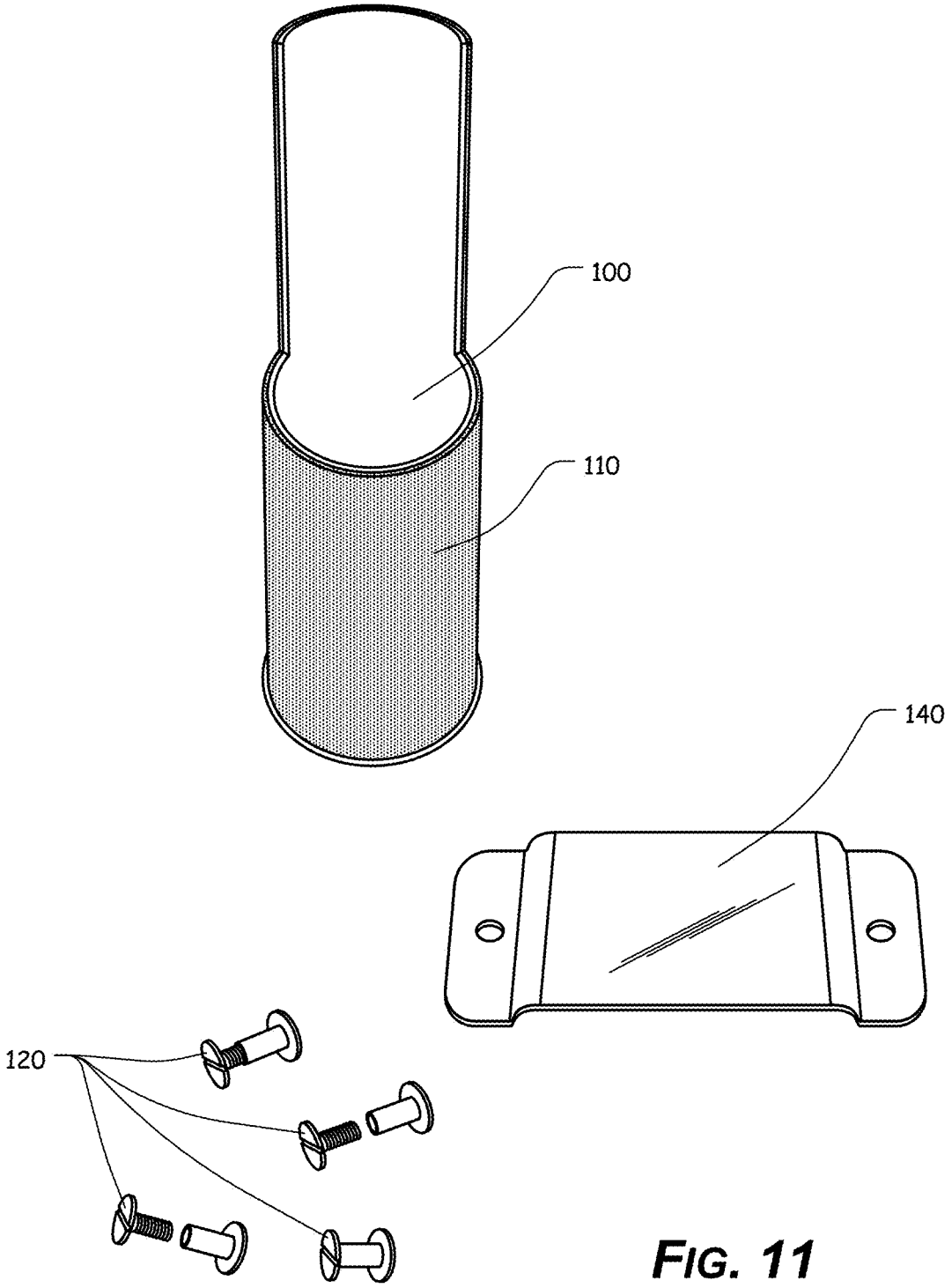
FIG. 11 illustrates an exemplary embodiment of components that may be assembled to form a holster for a light or aerosol, according to the present disclosure.
Figure 12:
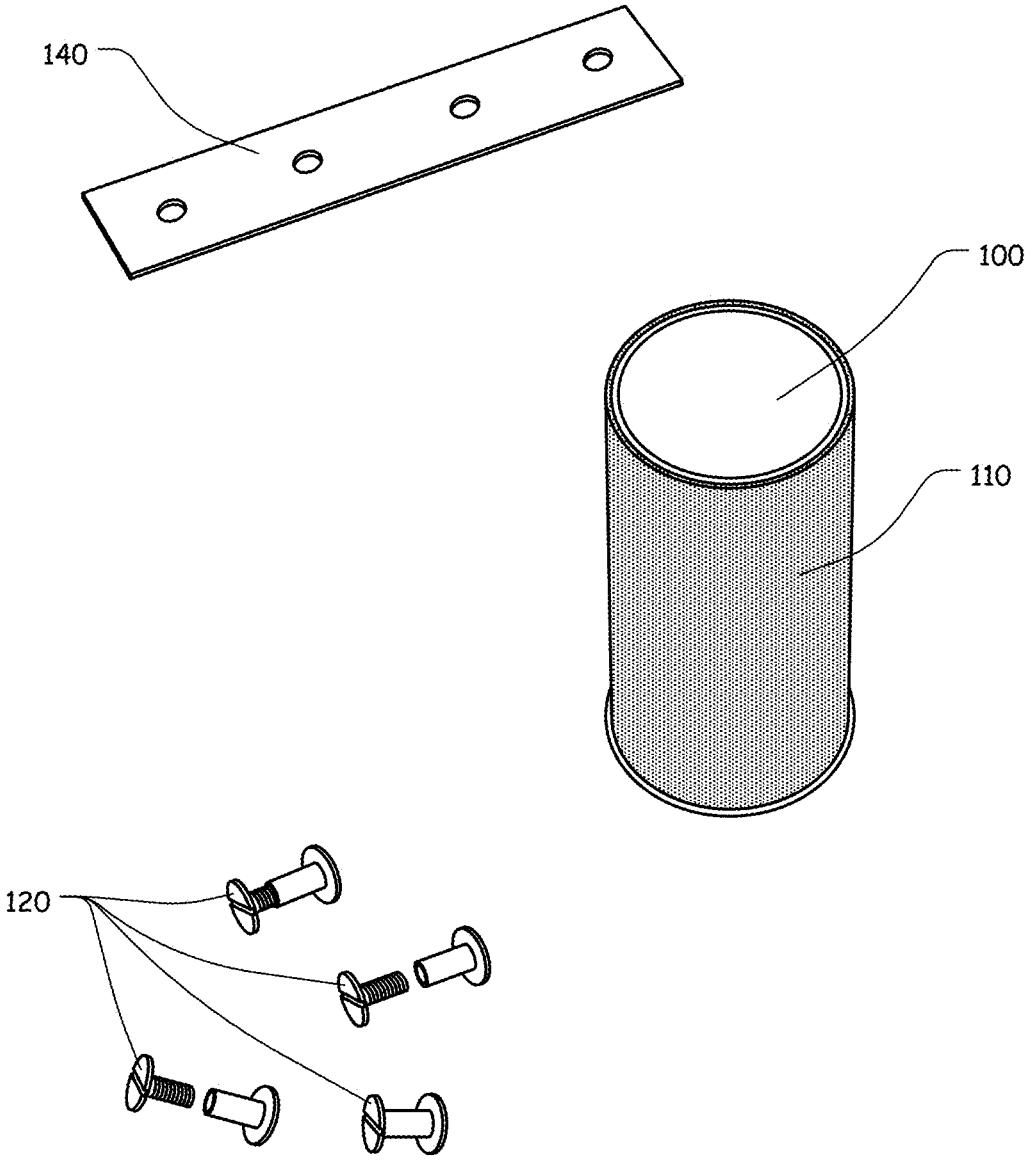
FIG. 12 illustrates an exemplary embodiment of components that may be assembled to form a holster for a baton, according to the present disclosure.
Figure 13:
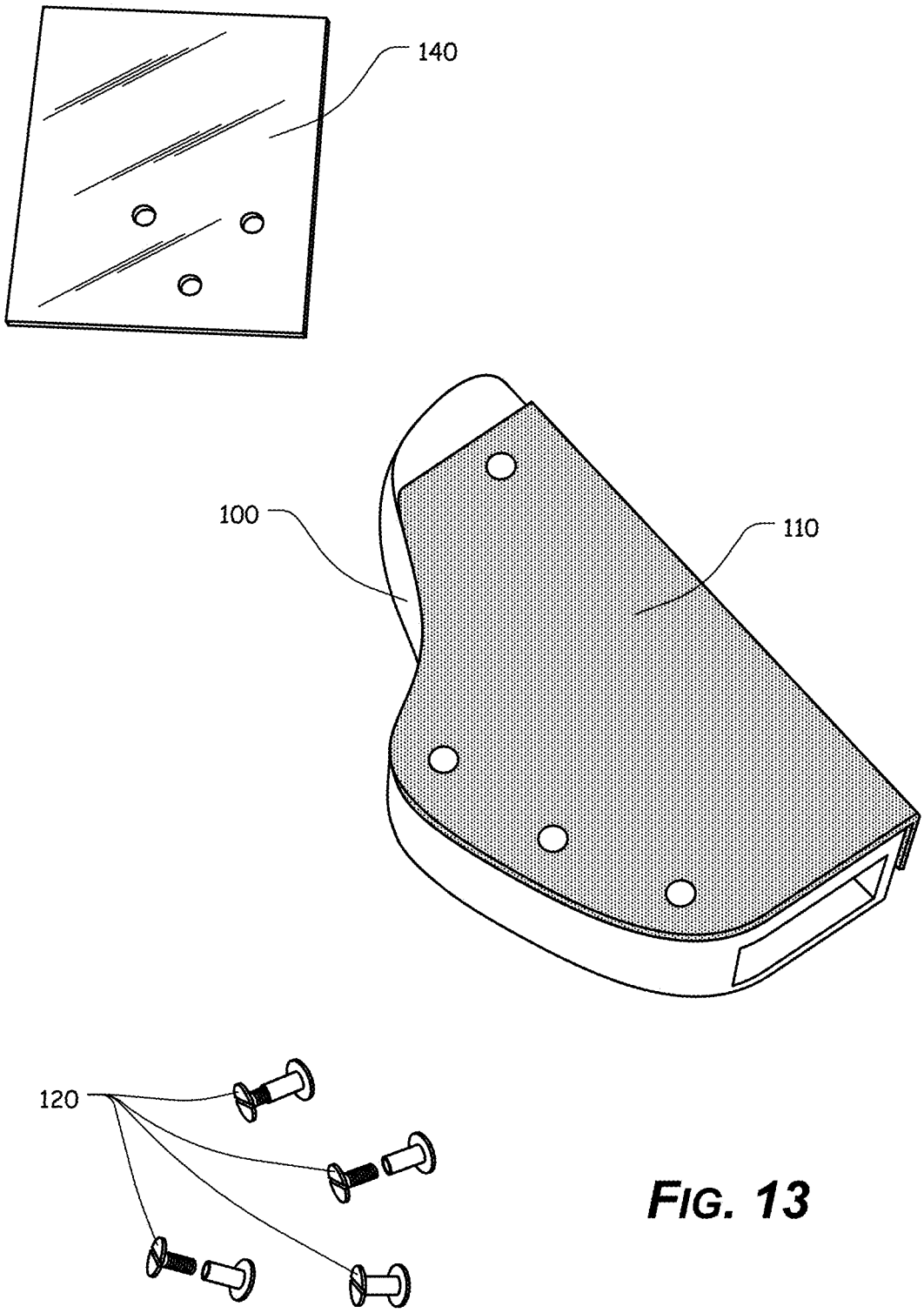
FIG. 13 illustrates an exemplary embodiment of a holster fora gun and an exemplary attachment element that may be selectively connected to the holster via the exemplary securing means shown, according to the present disclosure.
Figure 14:
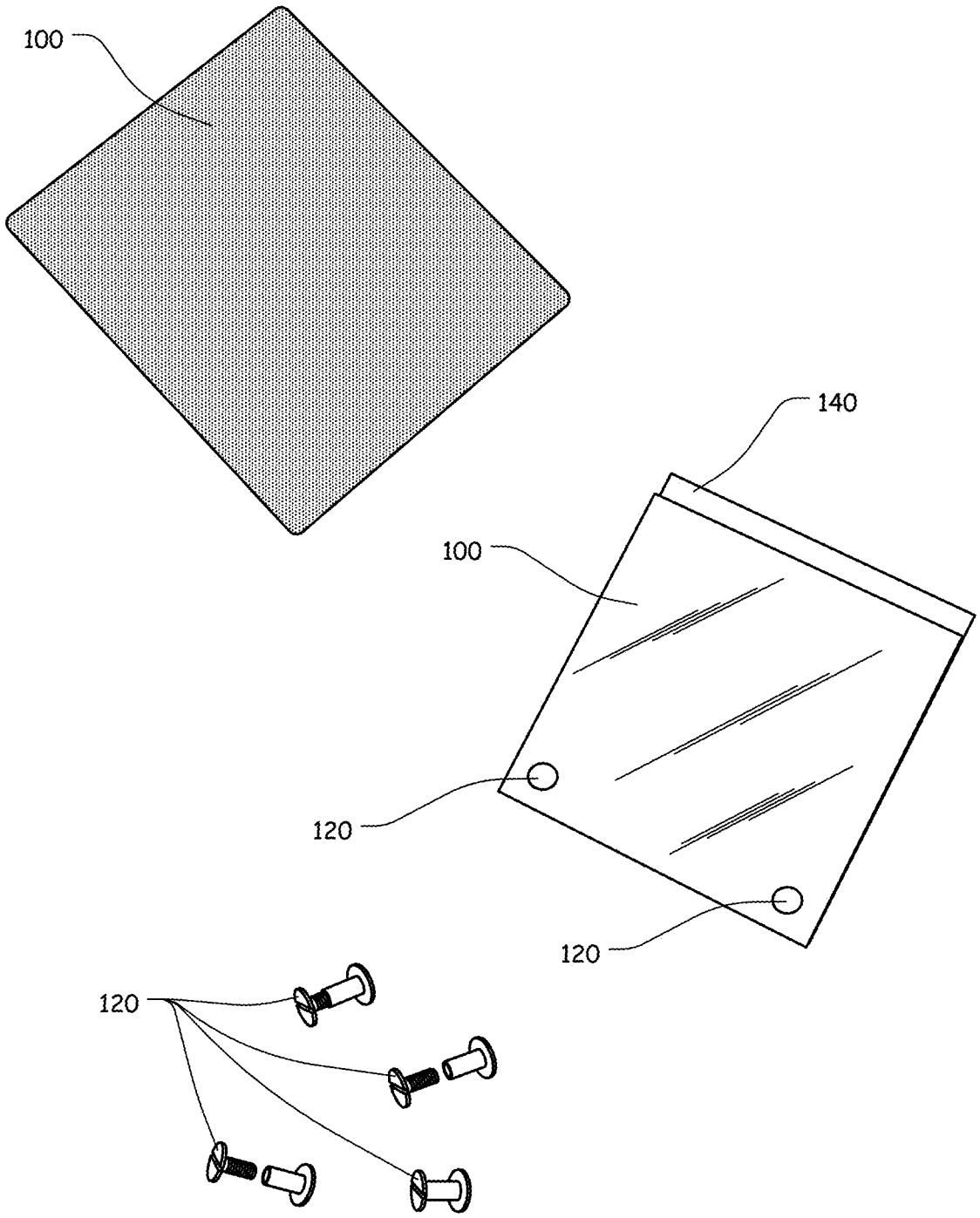
FIG. 14 illustrates an exemplary embodiment of components that may be assembled to form a holster for a pair of handcuffs, according to the present disclosure.
Figure 15:
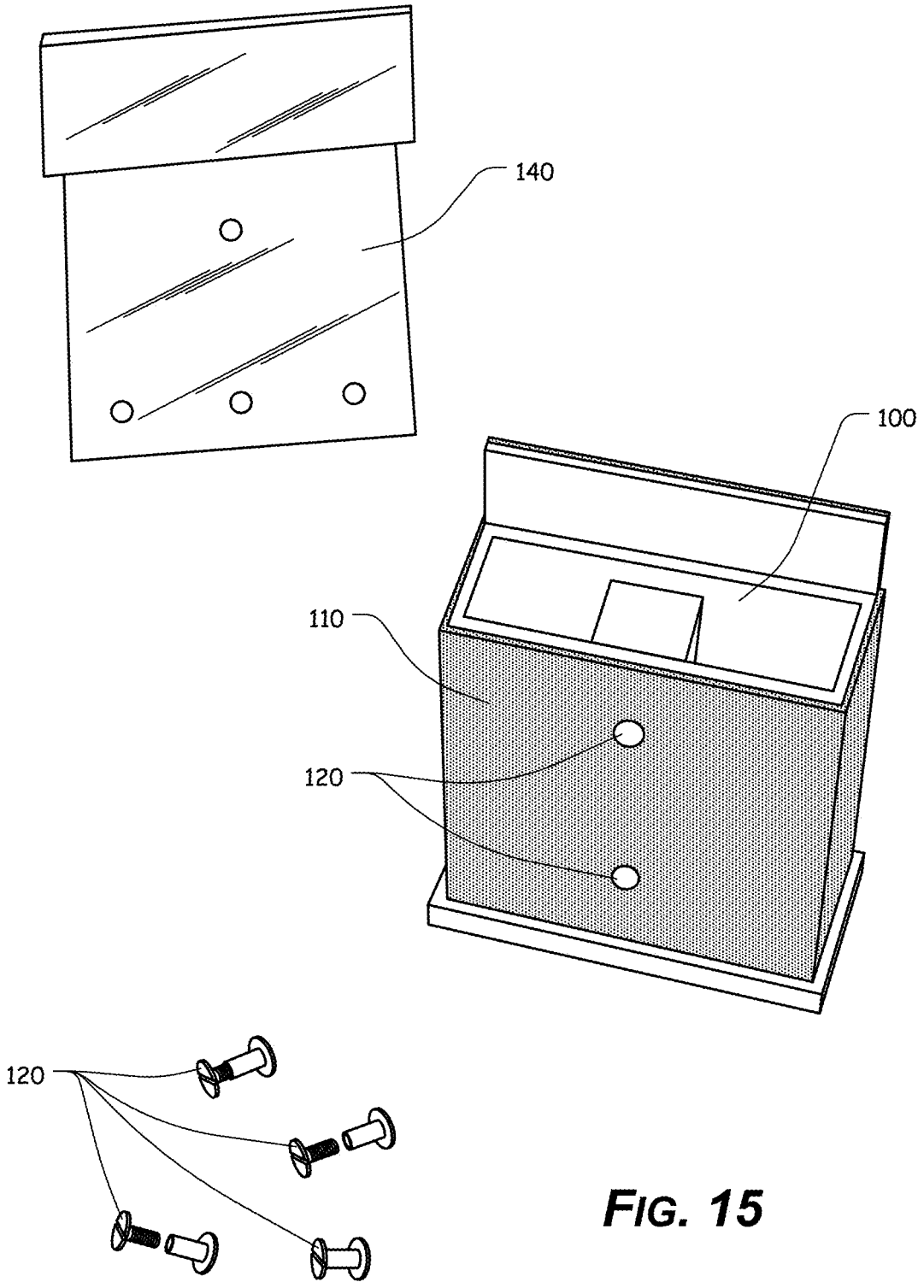
FIG. 15 illustrates an exemplary embodiment of components that may be assembled to form a magazine holster, according to the present disclosure.
Figure 16:
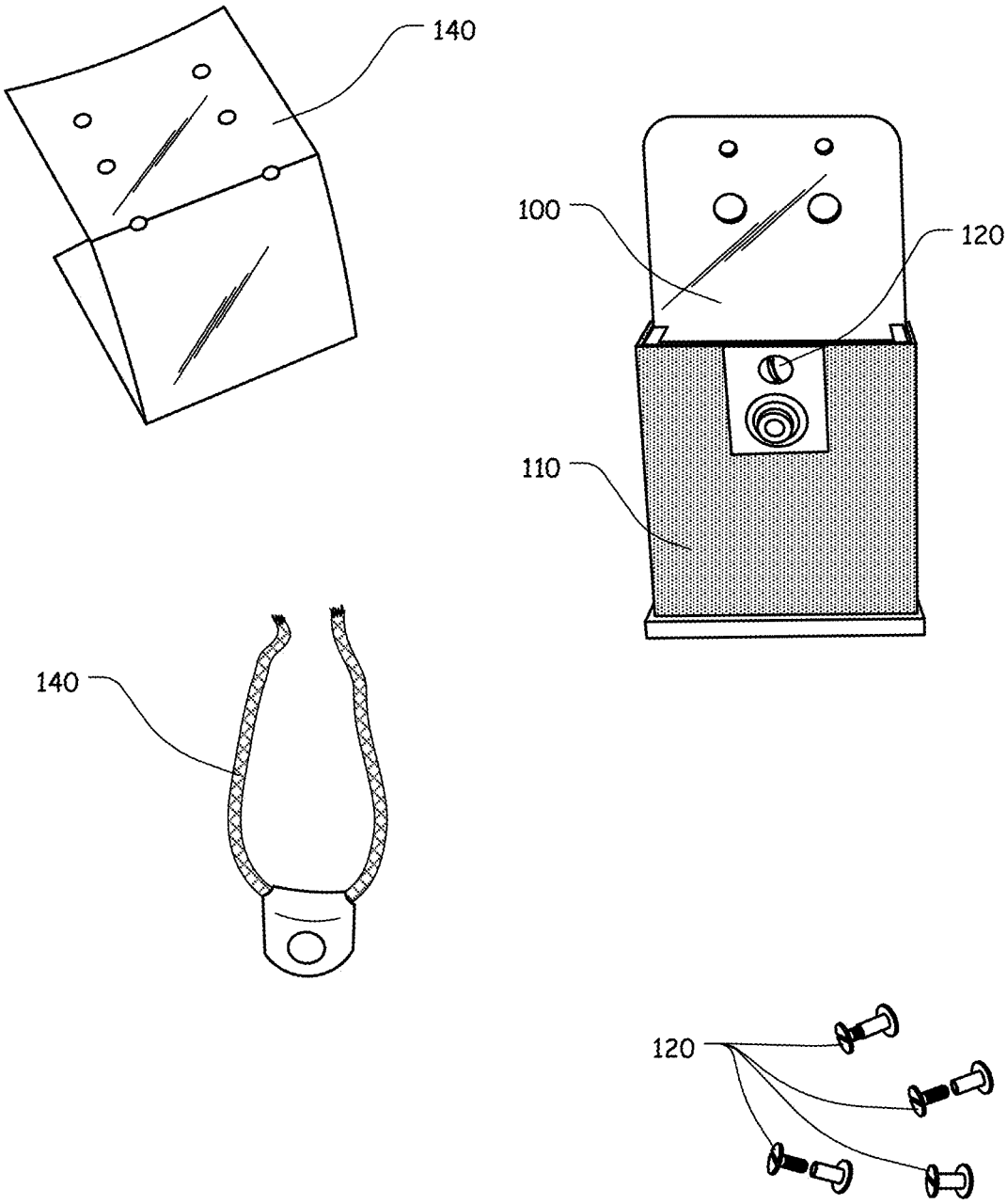
FIG. 16 illustrates an exemplary embodiment of components that may be assembled to form a radio case, according to the present disclosure.
Figure 17:
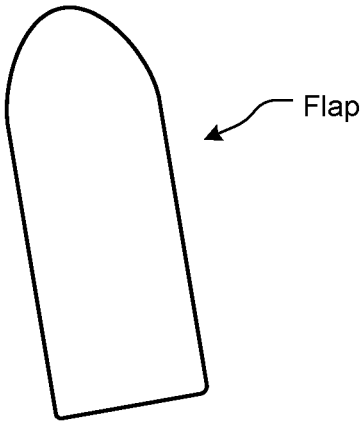
FIG. 17 illustrates an exploded, perspective view of an accessory container and replaceable cover system, according to the present disclosure.
Figure 17:
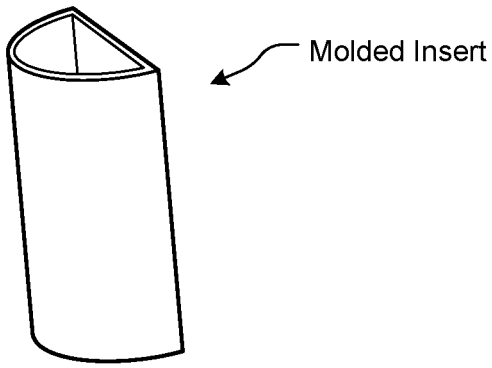
Figure 17:
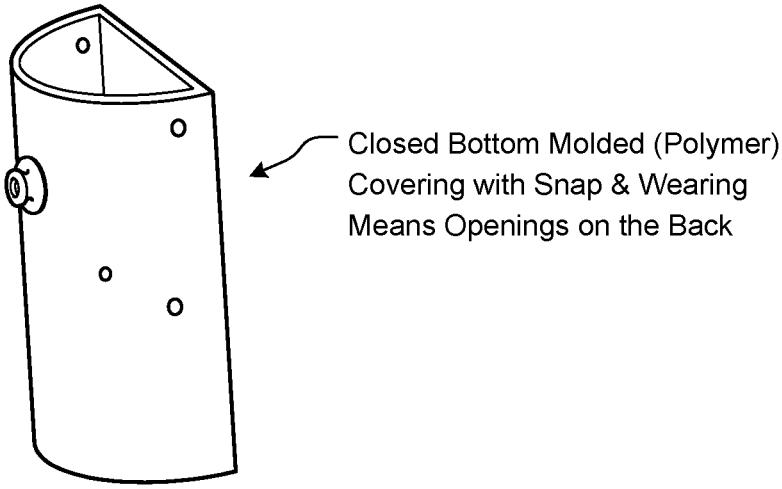
Figure 18:
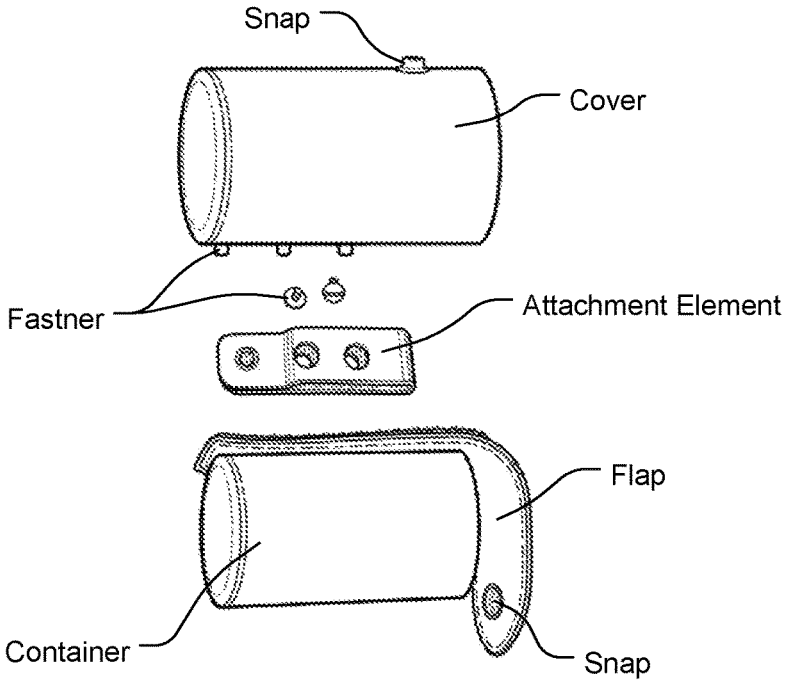
FIG. 18 illustrates various components of an accessory container and replaceable cover system, according to the present disclosure.
Figure 19:
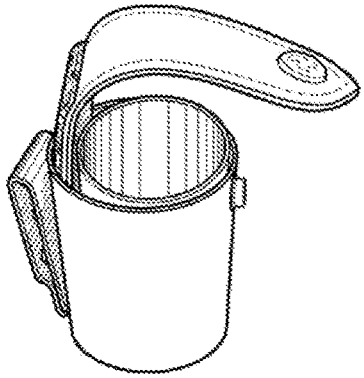
FIG. 19 illustrates an upper, perspective view of an accessory container and replaceable cover system, according to the present disclosure.
Figure 20:
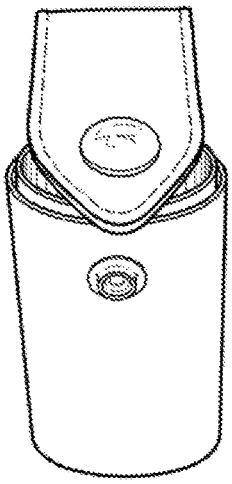
FIG. 20 illustrates an upper, front, perspective view of an accessory container and replaceable cover system, according to the present disclosure.
Figure 21:
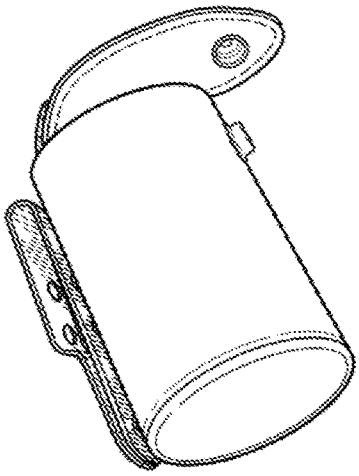
FIG. 21 illustrates a lower, side, perspective view of an accessory container and replaceable cover system, according to the present disclosure.
Figure 22:
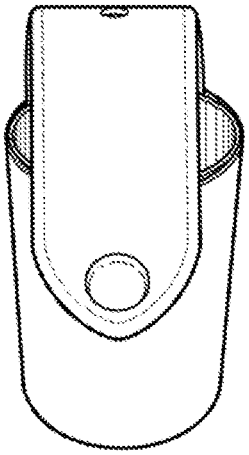
FIG. 22 illustrates an upper, front perspective view of an accessory container and replaceable cover system, according to the present disclosure.
Figure 23:
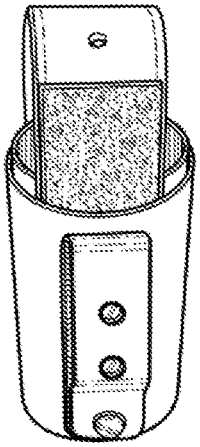
FIG. 23 illustrates an upper, rear perspective of an accessory container and replaceable cover system, according to the present disclosure.
Figure 24:
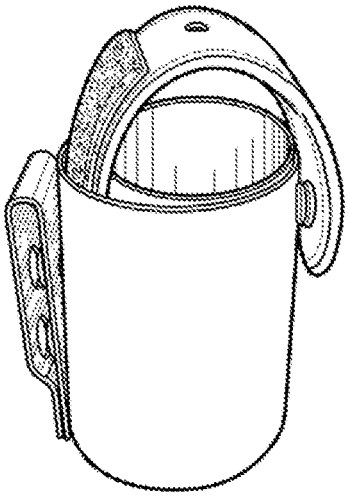
FIG. 24 illustrates an upper, side, perspective view of an accessory container and replaceable cover system, according to the present disclosure.
Figure 25:
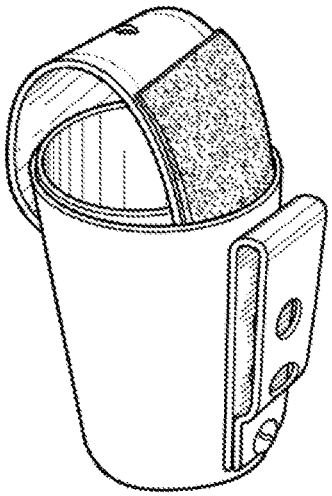
FIG. 25 illustrates an upper, rear, perspective view of an accessory container and replaceable cover system, according to the present disclosure.
Figure 26:
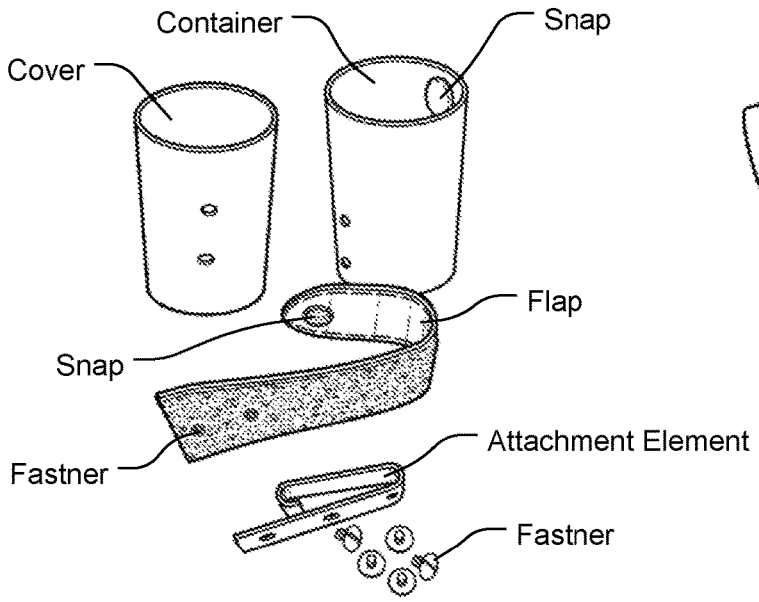
FIG. 26 illustrates various components of an accessory container and replaceable cover system, according to the present disclosure.
Figure 27:
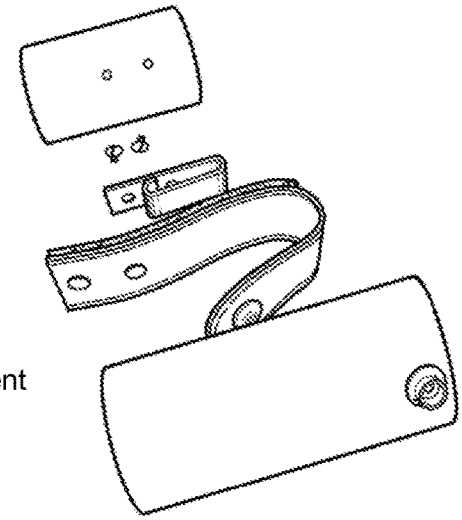
FIG. 27 illustrates various components of an accessory container and replaceable cover system, according to the present disclosure.
Figure 28:
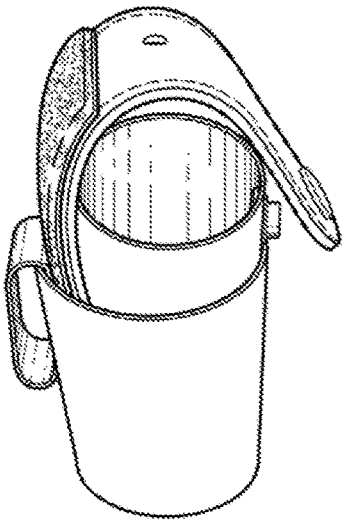
FIG. 28 illustrates an upper, side, perspective view of an accessory container and replaceable cover system, according to the present disclosure.
Figure 29:
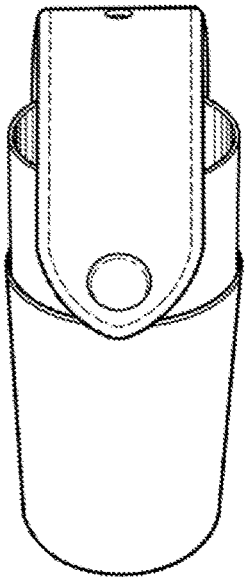
FIG. 29 illustrates an upper, front, perspective view of an accessory container and replaceable cover system, according to the present disclosure.
Figure 30:
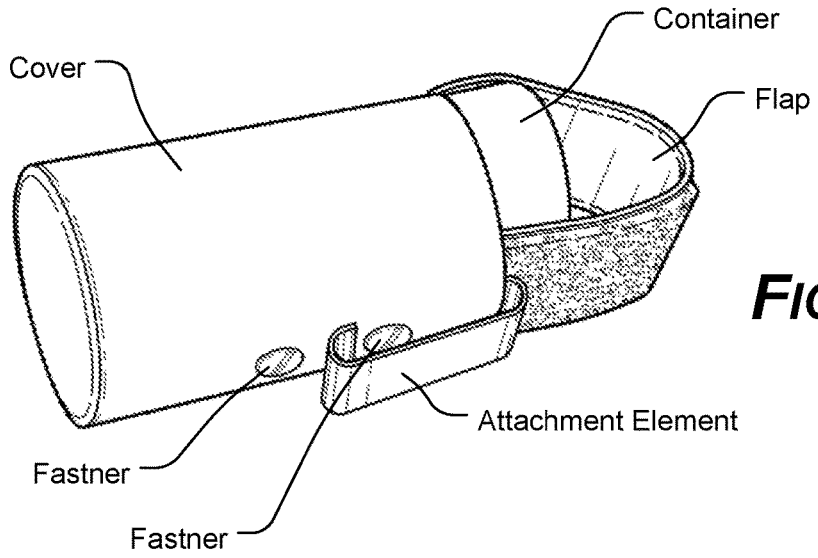
FIG. 30 illustrates a side, perspective view of an accessory container and replaceable cover system, according to the present disclosure.
Figure 31:
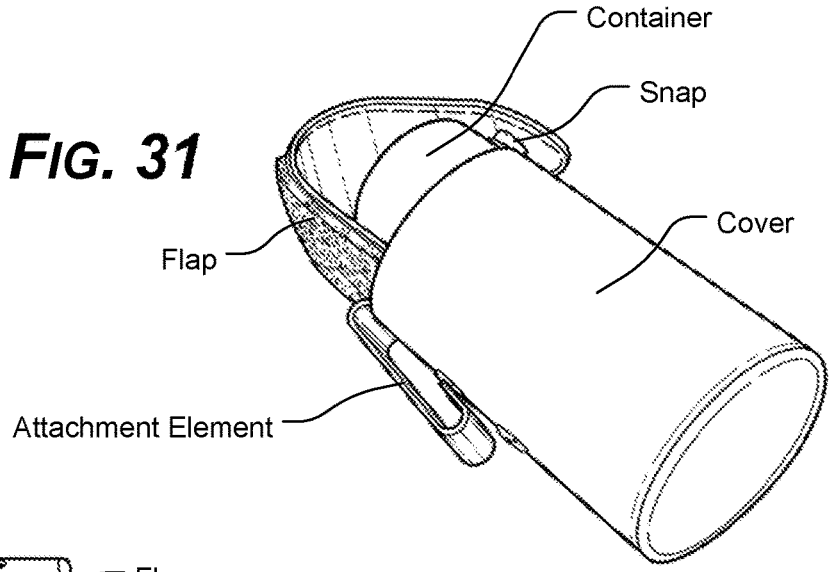
FIG. 31 illustrates a lower, side, perspective view of an accessory container and replaceable cover system, according to the present disclosure.
Figure 32:
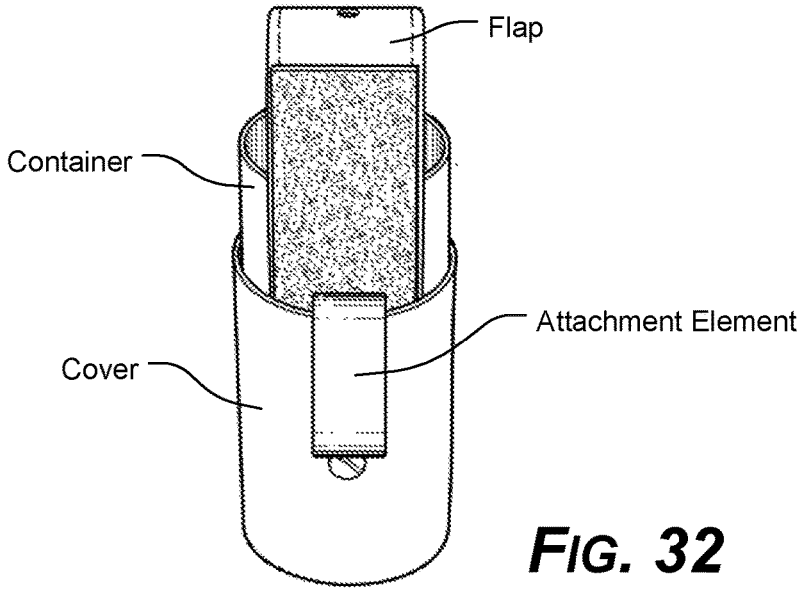
FIG. 32 illustrates an upper, rear, perspective view of an accessory container and replaceable cover system, according to the present disclosure.
Figure 33:
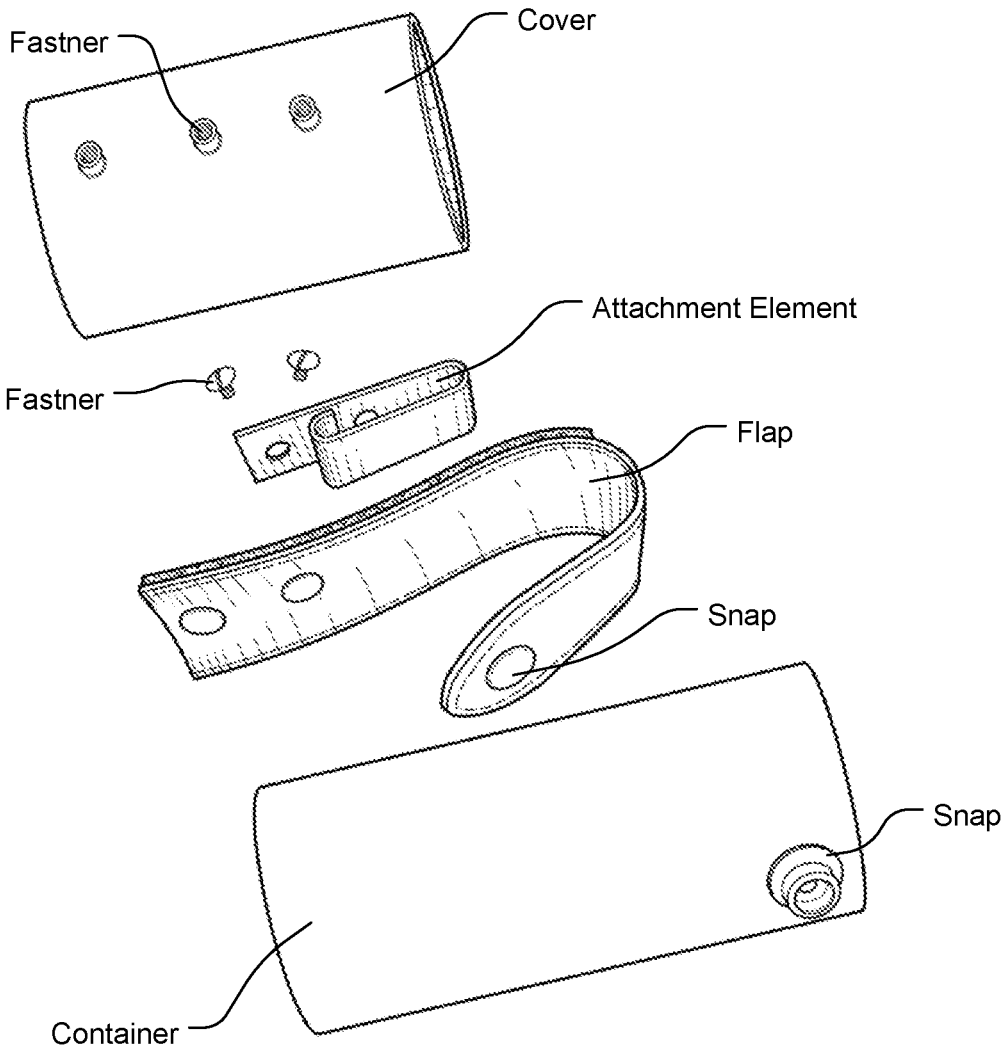
FIG. 33 illustrates various components of an accessory container and replaceable cover system, according to the present disclosure.

In an exemplary embodiment, as shown in FIGS. 9A and 9B, comprises several components that may be selectively unattached from each other. As shown in FIG. 9A, exemplary components of a holster may comprise a container 100, a cover 110, an attachment element 140, and a flap 150. FIG. 9B shows an exemplary embodiment of how the several components may be selectively assembled to form an exemplary holster. As shown in FIGS. 10A-10E, holsters may be configured to hold a variety of accessories. Exemplary embodiments include a holster where the container is configured to contain a gun (FIG. 10A), a baton (FIG. 10B), a radio (FIG. 10C), a magazine (FIG. 10D), a chemical agent, etc. (FIG. 10E), or any other suitable accessory. FIG. 11 shows a more detailed view of exemplary components that may be assembled to form a holster for a light or aerosol. FIG. 12 shows a more detailed view of exemplary components that may be assembled to form a holster for a baton. FIG. 13 shows a more detailed view of an exemplary holster for a gun shown with an exemplary attachment element that may be selectively connected to the holster via a securing means. FIG. 14 shows a more detailed view of exemplary components that may be assembled to form a holster for handcuffs. FIG. 15 shows a more detailed view of exemplary components that may be assembled to form a holster for a magazine. Similarly, FIG. 16 shows a more detailed view of exemplary components that may be assembled to form a case for a radio.

In some exemplary embodiments, a cover that may be selectively attached to a container via a securing means is reversible. A cover may be made from a variety of materials. In some exemplary embodiments, a cover comprises more than one layer of material. Some covers may comprise layers of different types of materials. Some materials that may be utilized by a cover are synthetics such as polymers or kydex, woven materials such as nylon fabrics, leather, and bullet-resistant materials, etc. In an exemplary embodiment, a cover comprises a first semi-rigid polymer layer and a second layer made from fabric or leather. The fabric or leather may be bonded to the polymeric layer via an adhesive, sewing, staple, etc. One or more layers of a cover may comprise bullet-resistant material.

In an exemplary embodiment, a container may be molded to form a rigid container for the accessory to be received therein (e.g., a gun), and to allow for easy insertion or removal of such accessory. In other exemplary embodiments, a container may be semi-rigid such that it defines and substantially retains a cavity of a specific shape. A semi-rigid container may be made from a polymer with low elasticity, a metal, etc. In some other exemplary embodiments, a container may be non-rigid. A non-rigid container may be made from a fabric, an elastic polymer, etc. A rigid or semi-rigid container may be preferable in that it may provide a better fit for contents of the container, minimize "play" within the container, enable easy insertion of contents into the container, make it more difficult for guns, a chemical agent, etc. that may be held in the container to be inadvertently engaged, and/or may be perceived as more attractive than a non-rigid container.

In one exemplary embodiment, a cover comprising a first side and a second side is reversible. When a cover comprising a first side and a second side is reversible, it may be selectively attached to a container such that either the first side or the second side is in contact with the container. A container that is reversible may have a first side with a first appearance and a second side with a second appearance. For example, the first side may comprise a reflective finish while the second side may comprise a camouflage finish, black finish, waterproof finish, etc.

One exemplary embodiment comprises a container and a cover where the cover is designed to be placed about the container. In this exemplary embodiment, the cover may be such that once placed about the container it will stay in a desired location until it is desired that the cover be removed. Application of an external force may be all that is required to remove the cover from the container. For example, the cover may have a sufficiently tight or frictional fit about the container, which may serve as the securing means optionally without the use of any other mechanical or adhesive fastener. In another exemplary embodiment, the container may comprise a reciprocal for receiving a portion of the cover when the cover is positioned about the container. Thus, the container and cover may be adapted to be selectively connected to each other without the assistance of an additional securing means. In one exemplary embodiment comprising a container and a cover adapted to fit about the container, the container may still be utilized to hold a gun, baton, power tool, etc. even after the cover has been selectively removed from about the container. In other words, removal of the cover may not affect the ability of the container to be utilized by a user for containing an accessory or accessories.

A further exemplary embodiment comprises a container, a cover adapted to fit about the container, and a holster accessory. In one exemplary embodiment, the holster accessory is selectively connected to the container by a securing means. In another exemplary embodiment, the accessory is permanently connected to the container. A permanent connection to the container may be made via sewing, adhesive, welding, a grommet, etc. When an accessory is connected to the container either selectively or permanently, it may be possible to remove the cover from about the container without removing the accessory from the container. In another exemplary embodiment, the accessory is connected to the cover by a securing means. In embodiments where the accessory is selectively connected to the cover, it may be possible to remove the cover from about the container without disconnecting the accessory from the cover. For example, one embodiment may comprise a container, a cover adapted to fit about the container, a first accessory connected to the container via a first securing means, and a second accessory connected to the cover via a second securing means.

Another exemplary embodiment may comprise a container and a cover adapted to fit about the container where the cover comprises a first and second layer. When a cover comprises a first and second layer, the second layer may substantially cover at least one entire side of the first layer. In such an embodiment, the second layer of the cover may endure wear and tear while protecting the first layer from exposure to elements that may degrade its quality, appearance, etc. It may be possible to selectively remove the second layer of the cover from the position in which it substantially covers at least one side of the first layer such that it no longer protects the first layer. Because the first layer has been protected from the elements by the second layer, the first layer of the cover may still look new. In one exemplary embodiment where a cover comprises a first and second layer, the first layer may be a permanent or removable layer while the second layer may be selectively removed from about the first layer and then replaced by a new second layer. In such an exemplary embodiment, the first cover layer may be connected to the container by a first securing means and the second cover layer may be connected to the first cover layer by a second securing means.

FIGS. 17-33 illustrate various exemplary embodiments of an accessory container and replaceable cover system of the present disclosure. As illustrated most clearly in FIGS. 17-25, the cover comprises a flexible, rigid, or molded element having one or more sidewalls and a bottom wall, defining a cavity. The container also comprises a rigid, semi-rigid, or molded element having one or more sidewalls and a bottom wall, defining the cavity. It should be appreciated that the container can be molded or formed so as to contain or at least partially contain any desired accessory.

One or more apertures are formed through the cover, such that when the container is at least partially positioned within the cover, one or more fasteners can be inserted at least partially through the apertures and aligned with one or more flaps 10/or attachment elements. The fasteners can then be attached so as to attach or couple the flap and attachment element to the cover.

In various exemplary embodiments, the cover covers the exterior bottom wall of the container and extends to cover the sidewalls of the container.

A portion of a snap is attached or coupled to the cover and a mating portion of a snap is attached or coupled to the flap. In this manner, the flap can be drawn at least partially over an opening of the container cavity and snapped to a closed position by interaction of the portions of the snap attached or coupled to the cover and the flap.

As illustrated most clearly in FIGS. 26-32, the cover comprises a flexible, rigid, or molded element having one or more sidewalls and a bottom wall, defining a cavity. The container also comprises a rigid, semi-rigid, or molded element having one or more sidewalls and a bottom wall, defining the cavity. It should be appreciated that the container can be molded or formed so as to contain or at least partially contain any desired accessory.

One or more alignable apertures are formed through the container and the cover, such that when the container is at least partially positioned within the cover, one or more fasteners can be inserted at least partially through the apertures formed through the container and the cover, and aligned with one or more flaps and/or attachment elements.

The fasteners can then be attached so as to attach or couple the container, the cover, the flap, and the attachment element to the cover.

In various exemplary embodiments, the cover covers the exterior bottom wall of the container and only extends to cover a portion of the sidewalls of the container.

A portion of a snap is attached or coupled to the container and a mating portion of a snap is attached or coupled to the flap. In this manner, the flap can be drawn at least partially over an opening of the container cavity and snapped to a closed position by interaction of the portions of the snap attached or coupled to the container and the flap.

While certain embodiments of the present disclosure are described in detail above, the scope of the disclosure is not to be considered limited by such disclosure, and modifications are possible without departing from the spirit of the disclosure as evidenced by the claims. For example, various configurations of the container, cover, and attachment element and other accessories may be implemented and fall within the scope of the claims. Various fasteners may be utilized as securing means and still fall within the scope of the claims disclosure. One skilled in the art would recognize that such modifications are possible without departing from the scope of the claims.

While this disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the embodiments or variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An replaceable cover for an accessory container, comprising:

a container comprising an inside surface and an outside surface, wherein said inside surface defines a cavity configured to retain at least a portion of an accessory, wherein one or more apertures are formed in said container;

a cover adapted to be selectively attached to and fit about at least a portion of said outside surface of said container about at least a bottom portion of said container, wherein one or more apertures are formed in said cover, and wherein said one or more apertures formed in said container are alignable with said one or more apertures formed in said cover when said cover is positioned about said container;

an attachment element adapted to be selectively connected to and removed from said container, wherein at least a portion of said attachment element extends from said container past an exterior surface of said cover; and a fastener, wherein said fastener passes through said at least one aligned, overlapping aperture in said cover and at least one aligned aperture in said attachment element, and wherein said fastener releasably holds said cover in a desired location on said container and releasably holds said attachment element in a desired position on said container.

2. The replaceable cover for an accessory container of claim 1, wherein said cover covers substantially all of said outside surface of said container.

3. The replaceable cover for an accessory container of claim 1, where said inside surface and said outside surface are formed by one or more sidewalls and wherein a bottom wall extends from at least a portion of said one or more sidewalls, further defining said cavity of said container.

4. The replaceable cover for an accessory container of claim 1, where said container is adapted to contain an accessory selected from a group consisting of a gun, a magazine, a knife, a baton or impact weapon, chemical agent, ammunition for a gun, a flash light, handcuffs, protective gloves, an electrical discharge stunning device, a recorder, a pager, a radio, a personal digital assistant, and a telephone.

5. The replaceable cover for an accessory container of claim 1, wherein said cover comprises a first side and a second side where said cover can be selectively attached to said container with either said first side or said second side being in contact with said outside surface of said container.

6. The replaceable cover for an accessory container of claim 1, wherein said cover cannot overlie said cavity of said container.

7. An replaceable cover for an accessory container, comprising:

a container defining a cavity for containing an accessory, wherein one or more apertures are formed in said container;

a cover adapted to be selectively attached to and fit about at least a portion of said outside surface of said container, wherein one or more apertures are formed in said cover, and wherein said one or more apertures formed in said container are alignable with said one or more apertures formed in said cover when said cover is positioned about said container;

a flap adapted to be selectively connected to and removed from said container;

an attachment element adapted to be selectively connected to and removed from said container; and a fastener, wherein said fastener passes through said at least one aligned aperture in said cover, and at least one aligned aperture in said flap, and at least one aligned aperture in said attachment element, and wherein said fastener releasably holds said cover in a desired location on said container, releasably holds said flap in a desired position on an inner surface or an outer surface of said container, and releasably holds said attachment element in a desired position on said container.

8. The replaceable cover for an accessory container of claim 7, wherein said attachment element is selected from a group consisting of a belt loop for duty use, a belt loop for plain clothes, a swivel belt loop attachment, a shoulder harness, a paddle attachment, a clip, a clamp, a MOLLE-type or MOLLE-compatible device, a tactical platform, a detachable belt loop, and a strap.

9. The replaceable cover for an accessory container of claim 7, wherein said cover comprises a first side and a second side where said cover can be selectively attached to said container with either said first side or said second side being in contact with said container.

10. The replaceable cover for an accessory container of claim 7, wherein said cover may be removed and/or replaced without removing said attachment element from said container.

11. The replaceable cover for an accessory container of claim 7, wherein said fastener comprises a screw.

12. The replaceable cover for an accessory container of claim 11, wherein said screw is received by a screw post that runs through said cover and said container when said fastener is selectively holding said cover in said desired location on said container.

13. The replaceable cover for an accessory container of claim 7, wherein said one or more apertures formed in said cover and said one or more apertures formed in said container are overlapping and alignable when said cover is positioned about said container.

14. The replaceable cover for an accessory container of claim 7, wherein when said cover is attached to said outside surface of said container, said cover cannot overlie said cavity of said container.

15. The replaceable cover for an accessory container of claim 7, wherein said container is adapted to hold an accessory selected from a group consisting of a gun, a magazine, a knife, a baton or other impact weapon, a chemical agent, ammunition for a gun, and a flash light.

16. An replaceable cover for an accessory container, comprising:

a container defining a cavity;

a cover adapted to be selectively attached to and fit about at least a portion of said container, and one or more apertures formed in said cover;

an attachment element adapted to be selectively connected to and removed from said container, wherein at least a portion of said attachment element extends past an outside surface of said cover when said cover is positioned about said container; and a fastener, wherein said fastener passes through said at least one aperture in said cover and at least one aligned aperture in said attachment element, and wherein said fastener releasably holds said cover in a desired location on said container and releasably holds said attachment element in a desired position relative to said container.

17. The replaceable cover for an accessory container of claim 16, wherein said fastener applies a force to said cover to hold said cover in a desired location on said container.

18. The replaceable cover for an accessory container of claim 16, wherein said cover comprises a first side and a second side, and wherein said cover can be selectively attached to said container with either said first side or said second side being in contact with said container.

19. The replaceable cover for an accessory container of claim 16, wherein said cover may be removed and/or replaced without removing said attachment element from said container.

20. The replaceable cover for an accessory container of claim 16, wherein when said cover is attached to said outside surface of said container, said cover cannot overlie said cavity of said container.

* * * * *